US011712598B2

(12) United States Patent
Yang

(10) Patent No.: US 11,712,598 B2
(45) Date of Patent: Aug. 1, 2023

(54) FITNESS EXERCISE APPARATUS

(71) Applicant: YANGZHOU JIUYI HARDWARE & MACHINERY CO., LTD., Jiangsu (CN)

(72) Inventor: Yen-Shuo Yang, Taichung (TW)

(73) Assignee: Yangzhou Jiuyi Hardware & Machinery Co., Ltd., Jiangsu (CN)

( * ) Notice: Subject to any disclaimer, the term of this patent is extended or adjusted under 35 U.S.C. 154(b) by 62 days.

(21) Appl. No.: 17/502,651

(22) Filed: Oct. 15, 2021

(65) Prior Publication Data

US 2023/0124790 A1 Apr. 20, 2023

(51) Int. Cl.
*A63B 21/00* (2006.01)
*A63B 21/062* (2006.01)
*A63B 22/00* (2006.01)

(52) U.S. Cl.
CPC ..... *A63B 21/152* (2013.01); *A63B 21/063* (2015.10); *A63B 21/154* (2013.01); *A63B 21/4029* (2015.10); *A63B 21/4034* (2015.10); *A63B 21/4035* (2015.10); *A63B 21/4043* (2015.10); *A63B 22/0087* (2013.01)

(58) Field of Classification Search
CPC . A63B 21/152; A63B 21/063; A63B 21/4029; A63B 21/4034; A63B 21/4035; A63B 21/4043; A63B 21/00058–00065; A63B 21/02; A63B 21/0442; A63B 21/055–0557; A63B 21/15–151; A63B 21/154–156; A63B 22/0087; A63B 2225/10–107
See application file for complete search history.

(56) References Cited

U.S. PATENT DOCUMENTS 4,793,608 A * 12/1988 Mahnke ..... A63B 21/154 482/142
6,585,626 B2 * 7/2003 McBride ..... A63B 21/04 482/133
6,595,905 B2 * 7/2003 McBride ..... A63B 21/4043 482/130
7,223,216 B1 * 5/2007 McBride ..... A63B 23/03566 482/121
7,429,236 B2 * 9/2008 Dalebout ..... A63B 21/154 482/121
7,537,552 B2 * 5/2009 Dalebout ..... A63B 23/1209 482/121
7,815,552 B2 * 10/2010 Dibble ..... A63B 21/154 482/92
8,002,677 B2 * 8/2011 Dibble ..... A63B 21/4047 482/92

(Continued)

*Primary Examiner* — Garrett K Atkinson
*Assistant Examiner* — Kathleen M Fisk
(74) *Attorney, Agent, or Firm* — Burris Law, PLLC

(57) ABSTRACT

A fitness exercise apparatus includes a base member, a support unit disposed on the base member, and a slide bar disposed on the support unit. A seat frame includes a connector connected to and slidable along the slide bar, a guide rail connected to the connector, and a foot post connected to the guide rail opposite to the connector. A swing frame is connected to the guide rail at a position corresponding to the foot post. An elastic cord unit includes a plurality of first and second elastic cords connected to the support unit. A pulling unit includes two first cables connectable with the first elastic cords. An operating unit is connectable with the first cables.

8 Claims, 21 Drawing Sheets

(56) References Cited

U.S. PATENT DOCUMENTS

| | | | | |
|---|---|---|---|---|
| 8,057,368 | B1 * | 11/2011 | Lyszczarz | A63B 21/0628 482/142 |
| 8,926,480 | B2 * | 1/2015 | Lyszczarz | A63B 21/4047 482/138 |
| 10,010,740 | B2 * | 7/2018 | Hockridge | A63B 21/0628 |
| 10,016,646 | B2 * | 7/2018 | Butler | A63B 21/062 |
| 10,426,990 | B2 * | 10/2019 | Hockridge | A63B 69/0057 |
| 11,338,168 | B2 * | 5/2022 | Yang | A63B 21/0552 |
| 2002/0077229 | A1 | 6/2002 | McBride | |
| 2004/0110612 | A1 * | 6/2004 | Read | A63B 22/0087 482/142 |
| 2007/0270293 | A1 * | 11/2007 | Zhuang | A63B 21/4029 482/121 |

* cited by examiner

FITNESS EXERCISE APPARATUS

FIELD

The disclosure relates to an exercise apparatus, more particularly to a fitness exercise apparatus that combines aerobic and strength training.

BACKGROUND

An exerciser, as disclosed in U.S. Patent Publication No. 20020077229A1, includes a frame assembly, a user support assembly disposed on the frame assembly, two bungee cords mounted on the frame assembly, and two pull cords respectively connected to the bungee cords. When a user is seated on the user support assembly, he/she can perform physical training through cooperation of the bungee cords and the pull cords. When not in use, the user support assembly is operated to pivot relative to the frame assembly so as to be disposed in an upright position for storage.

However, this kind of exerciser can only provide physical training in a sitting position, but not in a standing position because of the obstruction of the user support assembly which can cause falling and injury to the user.

SUMMARY

Therefore, an object of the present disclosure is to provide a fitness exercise apparatus that combines aerobic and strength training and that can be easily adjusted to suit different requirements of a user.

According to this disclosure, a fitness exercise apparatus comprises a main frame, a seat frame, a swing frame, an elastic cord unit, a pulling unit and an operating unit. The main frame includes a base member configured to be disposed on a support surface, a support unit disposed on the base member, and a slide bar that is disposed on the support unit, that extends along a horizontal direction, and that has a first end and a second end opposite to each other along the horizontal direction, and a middle portion between the first and second ends. The seat frame is slidably mounted on the slide bar, and includes a connector connected to the slide bar and slidable between the first and second ends thereof, a guide rail connected to the connector and transverse to the slide bar, a seat assembly slidably disposed on the guide rail, and a foot post connected to the guide rail opposite to the connector and disposed rearwardly of the base member.

The swing frame is connected to the guide rail at a position corresponding to the foot post. The elastic cord unit includes a plurality of first and second elastic cords connected to the support unit.

The pulling unit includes three first pulley sets disposed on the base member and the support unit, two first cables each of which is looped around the first pulley sets and connectable with at least one of the first elastic cords, a second pulley set including a plurality of pulleys disposed on the main frame, the seat frame and the swing frame, and a second cable looped around the pulleys of the second pulley set and connectable with at least one of the second elastic cords. The operating unit is connectable with the first cables.

BRIEF DESCRIPTION OF THE DRAWINGS

Other features and advantages of the disclosure will become apparent in the following detailed description of the embodiments with reference to the accompanying drawings, in which.

DETAILED DESCRIPTION

Figure 1:
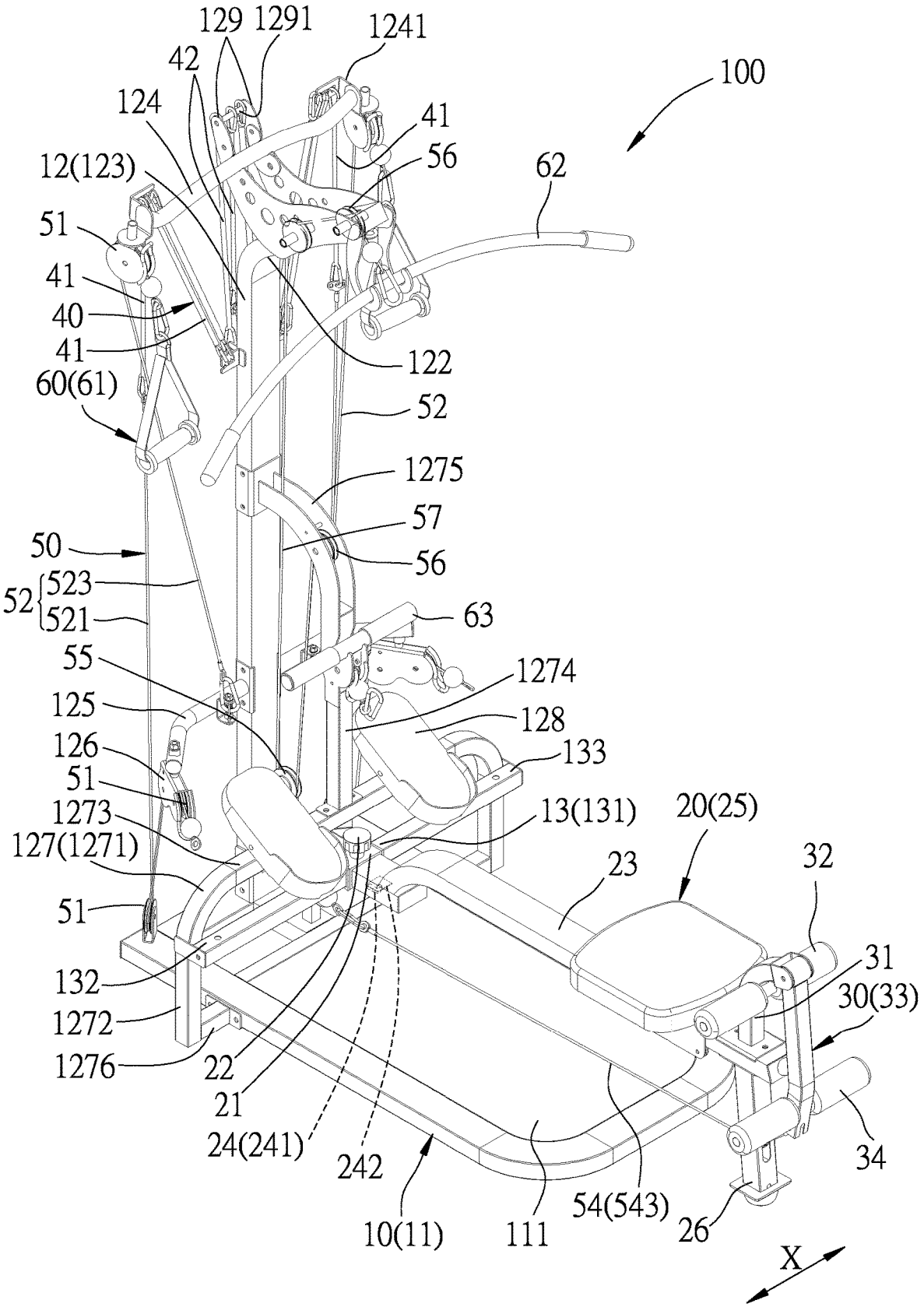
FIG. 1 is a perspective view of a fitness exercise apparatus according to the first embodiment of the present disclosure.

Before the present disclosure is described in greater detail with reference to the accompanying embodiments, it should be noted herein that like elements are denoted by the same reference numerals throughout the disclosure.

Figure 2:
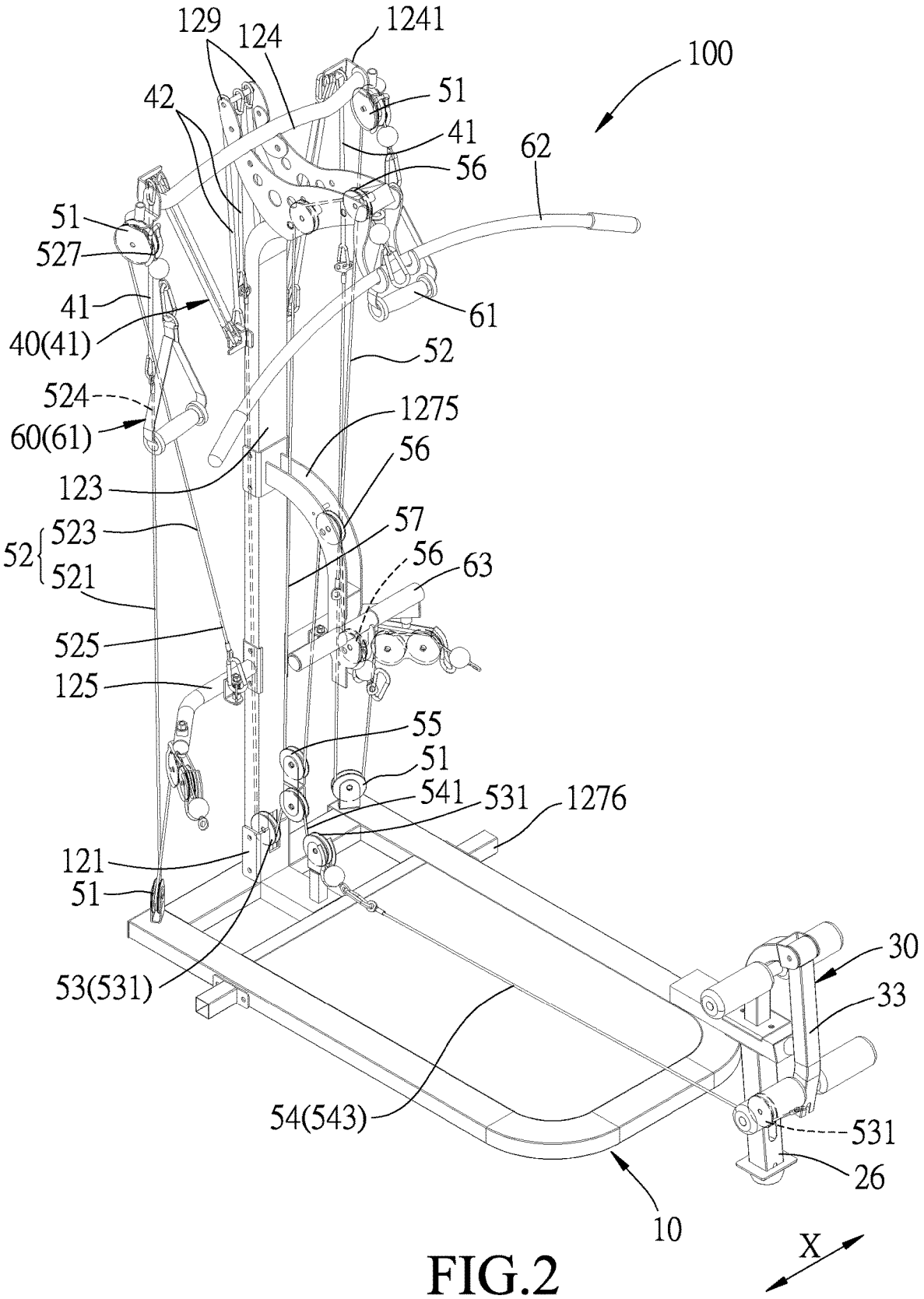
FIG. 2 is a view similar to FIG. 1, but with a portion of a seat frame and a portion of a fixing frame being removed for the sake of clarity.

Referring to FIGS. 1 and 2, a fitness exercise apparatus 100 according to the first embodiment of the present disclosure is shown to comprise a main frame 10, a seat frame 20, a swing frame 30, an elastic cord unit 40, a pulling unit 50, and an operating unit 60.

The main frame 10 includes a base member 11, a support unit 12 and a slide bar 13. The base member 11 is configured to be disposed on a support surface, such as a ground surface, and has an anti-skid plate 111 provided on a top surface thereof. The support unit 12 is disposed on the base member 11, and includes a support post 123, a cross bar 124, a hanging rod 125, two wheel frames 126, and a fixing frame 127. The support post 123 has a bottom portion 121 connected to the base member 11, and a top portion 122 opposite to the bottom portion 121 and provided with a pair of support plates 129 at a top end thereof. Each support plate 129 has a substantially L-shaped body. A rod 1291 is provided between top ends of the support plates 129.

The fixing frame 127 is connected between the base member 11 and the support post 123, and includes a substantially inverted U-shaped rod 1271, a vertical rod 1274, a curved rod 1275, and a horizontal rod 1276. The inverted U-shaped rod 1271 has two legs 1272 disposed on left and right sides of the base member 11, and a bight portion 1273 connected between top ends of the legs 1272. The vertical rod 1274 is connected to and extends upwardly from the bight portion 1273. The curved rod 1275 has an upper end connected to a central portion of the support post 123, and a lower end connected to a top end of the vertical rod 1274. The horizontal rod 1276 is inserted through a front portion of the base member 11, and has two opposite ends respectively connected to the legs 1272 such that the horizontal rod 1276 is opposite to the bight portion 1273. A pair of foot pedals 128 are mounted on the bight portion 1273.

The slide bar 13 extends along a horizontal direction (X), and has a first end 132 and a second end 133 opposite to each other along the horizontal direction (X) and respectively connected to the legs 1272 of the inverted U-shaped rod 1271, and a middle portion 131 between the first and second ends 132, 133. In this embodiment, the horizontal direction (X) is a left-right horizontal direction.

The cross bar 124 is positioned on top of the pair of support plates 129 in proximity to the rod 1291, and has two opposite ends respectively located on left and right sides of the support post 123 along the horizontal direction (X) and respectively provided with an L-shaped plate 1241.

The hanging rod 125 is connected to the support post 123 between the top and bottom portions 122, 121 thereof, and has two opposite ends respectively located on the left and right sides of the support post 123. The wheel frames 126 are respectively disposed on the opposite ends of the hanging rod 125.

Figure 3:
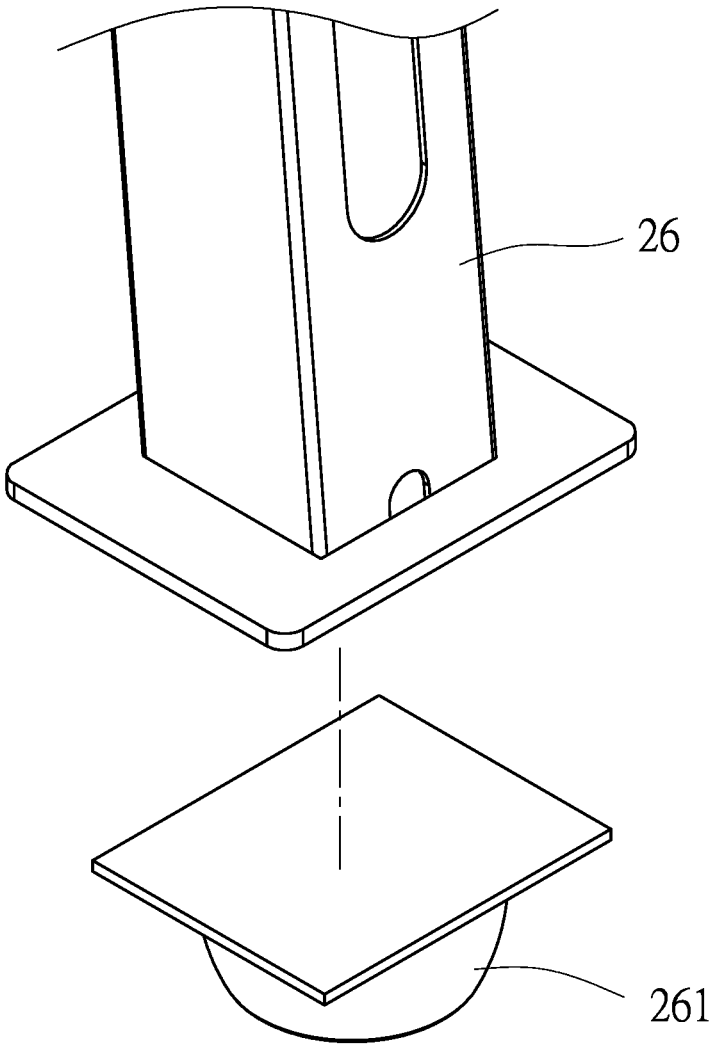
FIG. 3 is an exploded perspective view of a foot post and a roller of the first embodiment.
Figure 4:
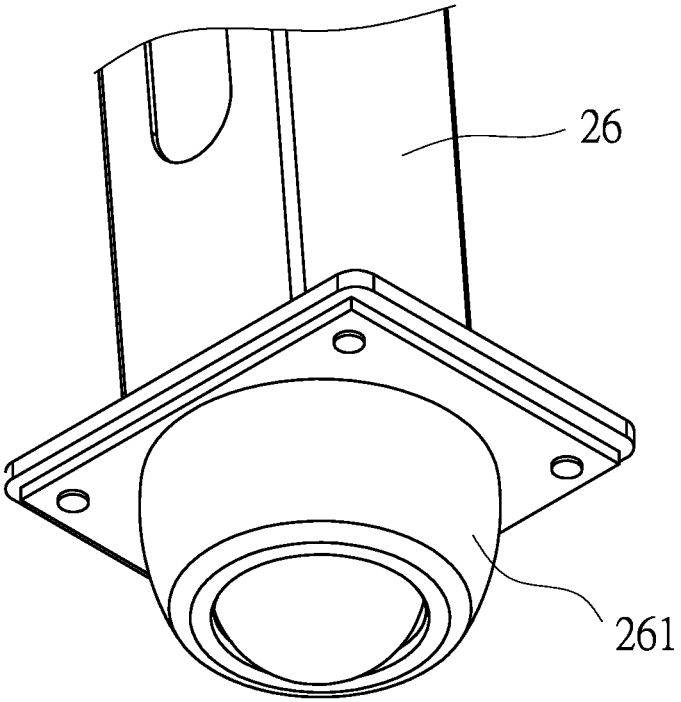
FIG. 4 is an assembled perspective view of FIG. 3.
Figure 5:
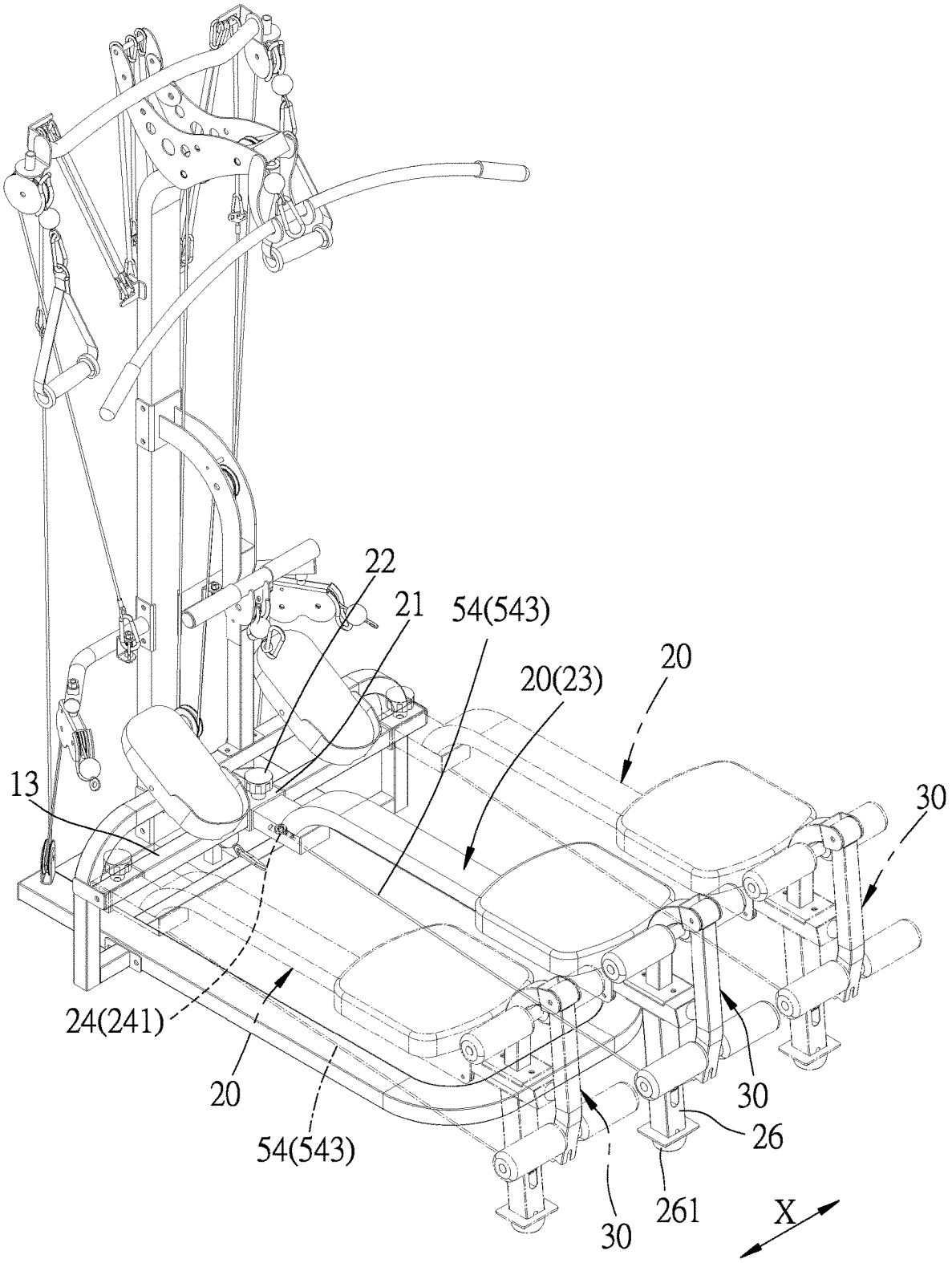
FIG. 5 is a view similar to FIG. 1, but illustrating how the seat frame can be adjusted and moved to different positions.

Referring to FIGS. 3 and 4, in combination with FIG. 1, the seat frame 20 is slidably mounted on the slide bar 13, and includes a connector 21, a knob 22, a guide rail 23, a cable-hooking mechanism 24, a seat assembly 25, and a foot post 26. The connector 21 is connected to the slide bar 13, and is slidable between the first and second ends 132, 133 thereof. The knob 22 is screwed to the connector 21. The guide rail 23 is transverse to the slide bar 13, and has a front end fixed to the connector 21, and a rear end opposite to the front end. The cable-hooking mechanism 24 is disposed on the connector 21, and as can be clearly seen in FIG. 14, includes a hook 241 fixed to a bottom portion of the connector 21, and a magnet 242 disposed inside the connector 21 at a position corresponding to the hook 241. The seat assembly 25 is slidably disposed on the guide rail 23. The foot post 26 is disposed rearwardly of the base member 11, and has a top portion connected to the rear end of the guide rail 23, and a bottom portion attached with a roller 261 for rolling contact with the support surface. The roller 261 of this embodiment is a universal ball bearing or bull's eye bearing.

The swing frame 30 includes a connecting rod 31 having a bottom end connected to the rear end of the guide rail 23 at a position corresponding to the foot post 26, two knee support rods 32 connected to two opposite sides of the connecting rod 31, a swing rod 33 pivoted to a top end of the connecting rod 31 and swingable toward and away from the foot post 26, and two positioning rods 34 connected to two opposite sides of the swing rod 33 and distal to the knee support rods 32.

The elastic cord unit 40 includes a plurality of first elastic cords 41 disposed on the opposite ends of the cross bar 124, and a plurality of second elastic cords 42 disposed on the pair of support plates 129. Three first elastic cords 41 disposed on each end of the cross bar 124 and having different thicknesses are exemplified in this embodiment. Each first elastic cord 41 has a first end hooked to the L-shaped plate 1241 provided on a corresponding one of the opposite ends of the cross bar 124, and a second end for connection with the pulling unit 50. The second end of each first elastic cord 41 is hooked to a retainer provided on a corresponding one of left and right lateral surfaces of the support post 123 when not in use. Three second elastic cords 42 having different thicknesses are also exemplified in this embodiment. Each second elastic cord 42 has a first end hooked to the rod 1291 provided between the top ends of the support plates 129, and a second end for connection with the pulling unit 50. The second end of each second elastic cord 42 is hooked to the retainer provided on the corresponding one of the left and right lateral surfaces of the support post 123 when not in use.

The pulling unit 50 includes three first pulley sets 51, two first cables 52, a second pulley set 53, a second cable 54, a movable pulley set 55, two auxiliary pulley sets 56, and an auxiliary cable 57. One of the first pulley sets 51 includes two pulleys respectively disposed on left and right front ends of the base member 11. A second one of the first pulley sets 51 includes two pairs of pulleys respectively disposed on the wheel frames 126. A third one of the first pulley sets 51 includes two pulleys respectively disposed on the L-shaped plates 1241 provided on the opposite ends of the cross bar 124. The second pulley set 53 includes three pulleys 531, one of which is disposed in the bottom portion 121 of the support post 123, a second one of which is disposed on the base member 11 in proximity to a middle front end thereof, and a third one of which is disposed in the foot post 26. The movable pulley set 55 is disposed in proximity to the bottom portion 121 of the support post 123, and includes two pulleys disposed one above the other. One of the auxiliary pulley sets 56 includes two pulleys spacedly disposed on the top portion 122 of the support post 123 between the pair of support plates 129. The other auxiliary pulley set 56 includes two pulleys spacedly disposed on the curved rod 1275 of the fixing frame 127.

The first cables 52 are respectively located on the left and right sides of the support post 123. Each first cable 52 includes a first cable section 521 and a second cable section 523. The first cable section 521 has a first end 522 (see FIG. 9) extending out of a corresponding one of the pairs of pulleys of the second one of the first pulley sets 51 and connectable with the operating unit 60, and a second end 524 looped around one of the pulleys of the first one of the first pulley sets 51 and then extending out of the same for connection with the second end of at least one of the first elastic cords 41. The second cable section 523 has a first end 525 selectively hooked to a retainer provided on one side of the hanging rod 125 in proximity to the support post 123 and the first end 522 of the first cable section 521, and a second end 527 looped around one of the pulleys of the third one of the first pulley sets 51 and then extending out of the same for connection with the operating unit 60.

Figure 14:
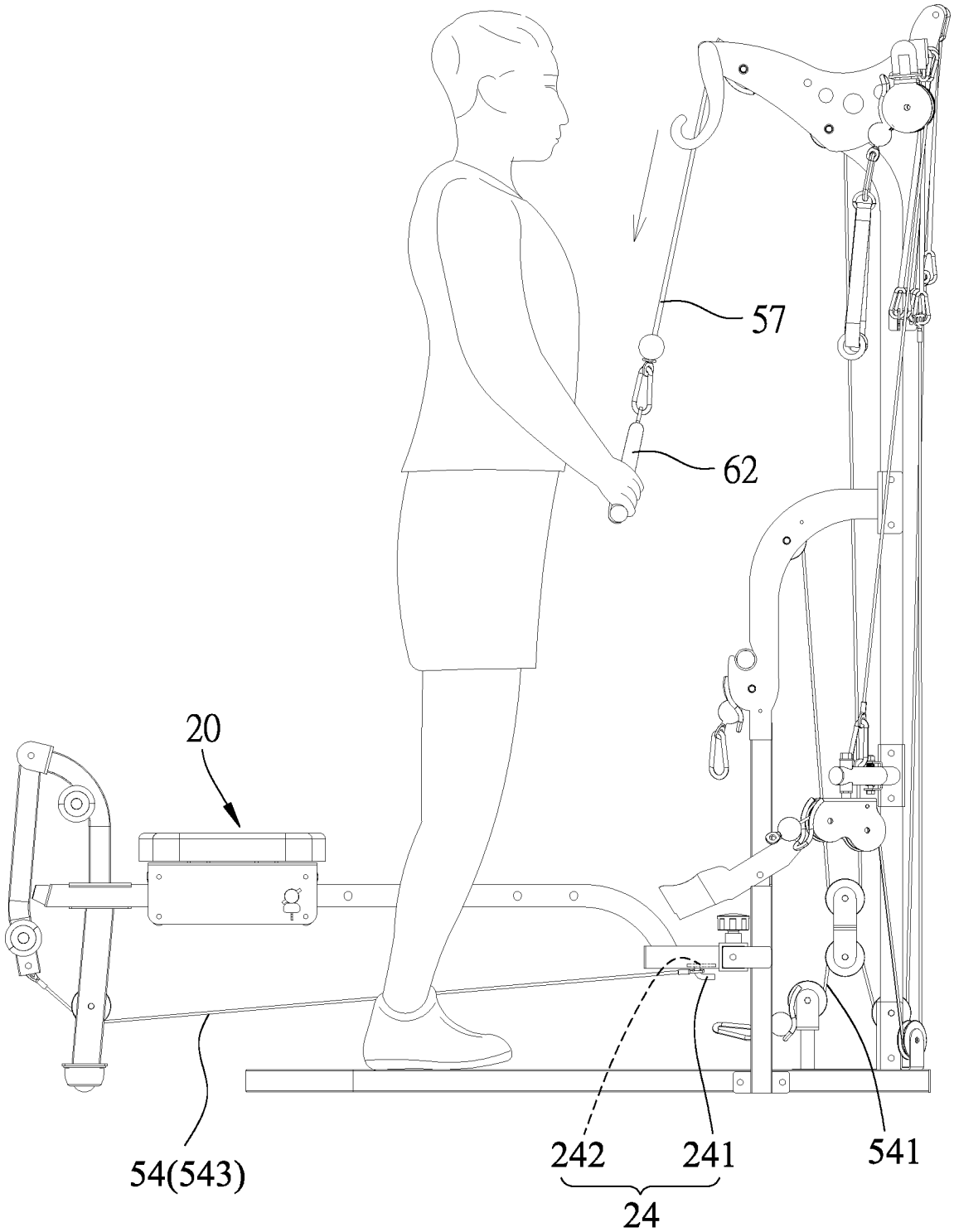
FIG. 14 illustrates how the user can perform a triceps push down exercise when the seat frame is moved to the left position.

The second cable 54 includes a first cable section 541 and a second cable section 543. The first cable section 541 is looped around the pulley 531 of the second pulley set 53 disposed on the base member 11 in proximity to the middle front end thereof, a lower pulley of the movable pulley set 55, and the pulley 531 of the second pulley set 53 disposed in the bottom portion 121 of the support post 123, and has a first end extending out of the pulley 531 of the second pulley set 53 disposed on the base member 11, and a second end connected to the second end of at least one of the second elastic cords 42. The second cable section 543 is looped around the pulley 531 of the second pulley set 53 disposed in the foot post 26, and has a first end detachably connected to the first end of the first cable section 541, and a second end fixed to the swing rod 33. The first end of the second cable section 543 can be hooked to the hook 241 of the cable-hooking mechanism 24 after being detached from the first end of the first cable section 541, and can be positioned to the bottom portion of the connector 21 through the magnetic attraction of the magnet 242 disposed inside the connector 21, as shown in FIG. 14.

The auxiliary cable 57 is looped around the pulleys of the auxiliary pulley set 56 disposed on the curved rod 1275 of the fixing frame 127, an upper pulley of the movable pulley set 55, and the pulleys of the auxiliary pulley set 56 disposed on the top portion 122 of the support post 123, and has a first end extending out of the pulleys of the auxiliary pulley set 56 disposed on the curved rod 1275 for connection with the operating unit 60, and a second end extending out of the pulleys of the auxiliary pulley sets 56 disposed on the top portion 122 of the support post 123 for connection with the operating unit 60.

The operating unit 60 includes two handles 61, an upper pull rod 62 and a lower pull rod 63. The handles 61 may be connected detachably and respectively to the second ends 527 of the second cable sections 523 of the first cables 52 or the first ends 522 of the first cable sections 521 of the first cables 52 depending on the training exercise. The upper pull rod 62 is detachably connected to the second end of the auxiliary cable 57, and is positioned on a pair of hook members provided on the pair of support plates 129 when not in use. The lower pull rod 63 is detachably connected to the first end of the auxiliary cable 57, and is positioned on a lower portion of the curved rod 1275 when not in use.

Figure 6:
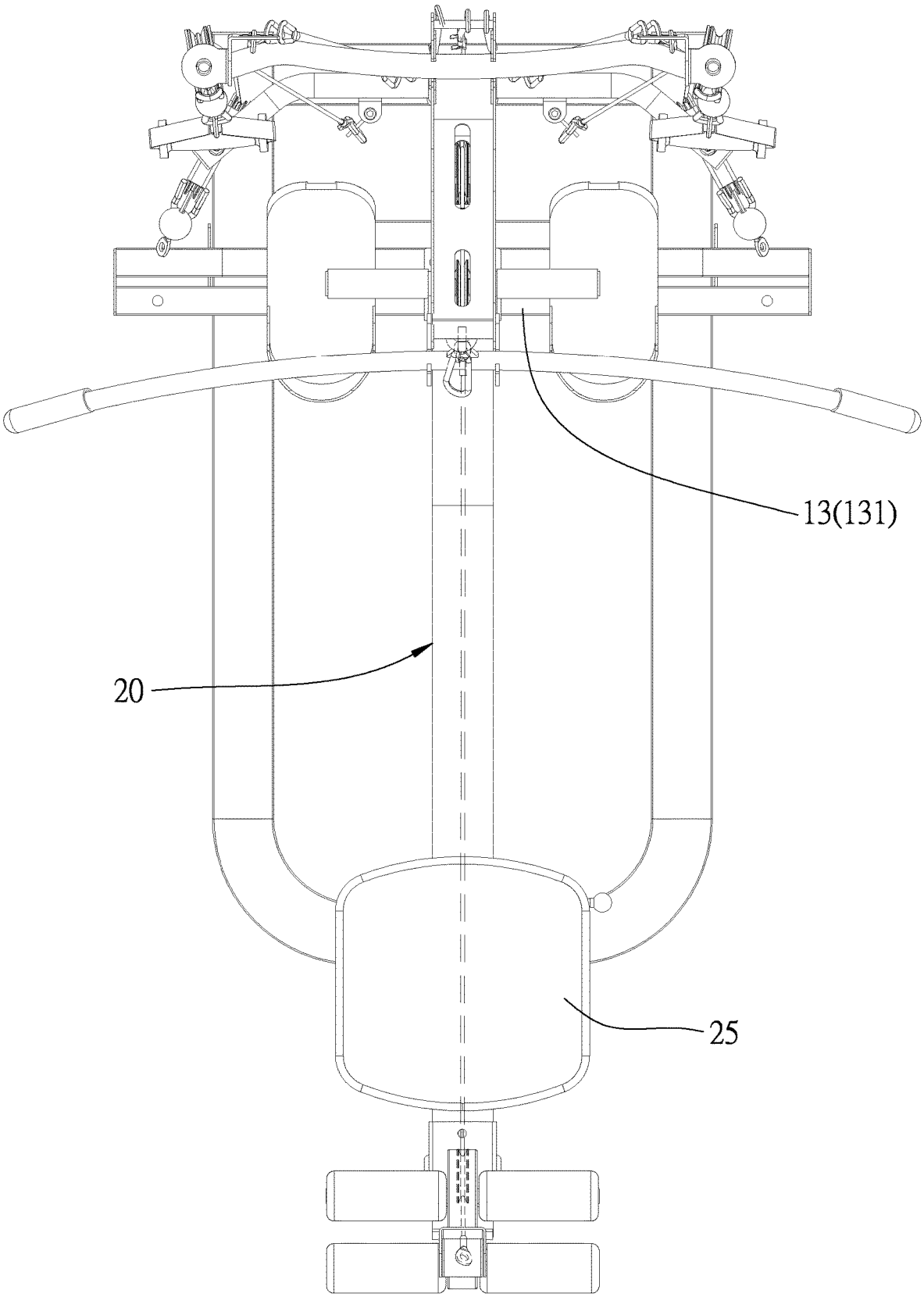
FIG. 6 is a schematic top view of the first embodiment, illustrating the seat frame in a middle position.
Figure 7:
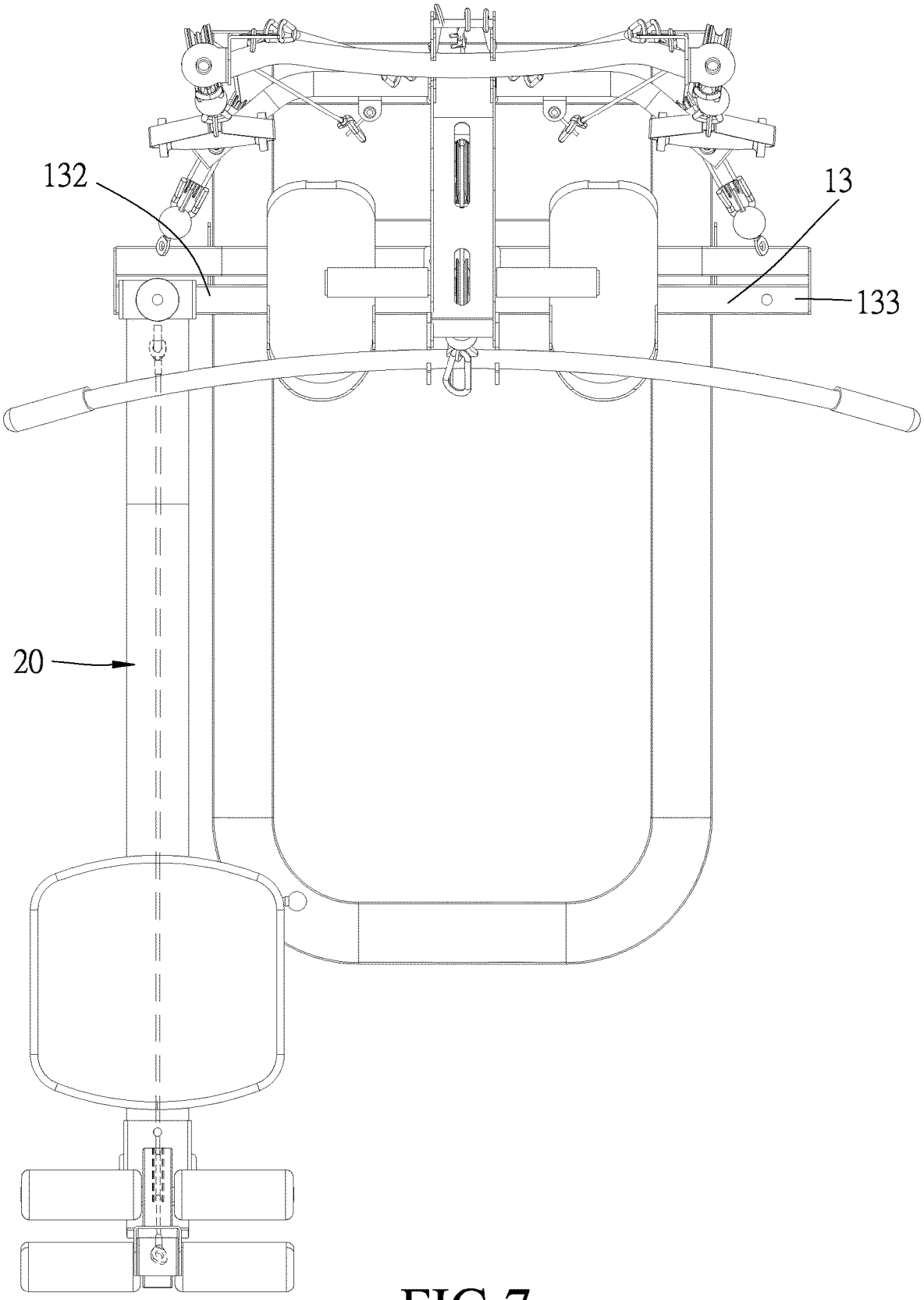
FIG. 7 is a view similar to FIG. 6, but illustrating the seat frame in a left position.
Figure 8:
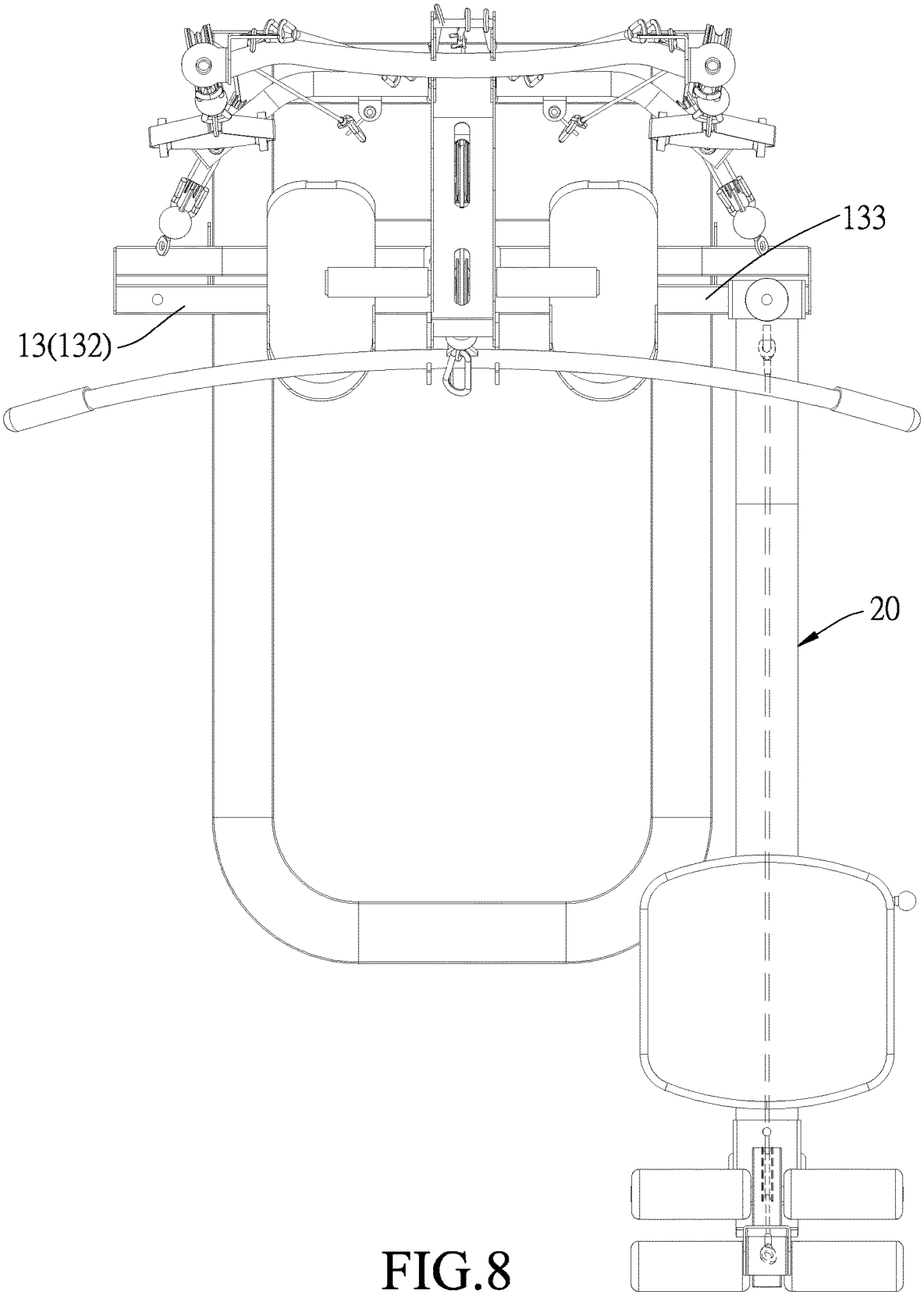
FIG. 8 is a view similar to FIG. 6, but illustrating the seat frame in a right position.

Referring to FIGS. 5 to 8, in combination with FIG. 1, the position of the seat frame 20 can be adjusted depending on the training exercise of a user, and can be positioned at the center of the fitness exercise apparatus 100, as shown in FIG. 6, at a left side of the fitness exercise apparatus 100, as shown in FIG. 7, and a right side of the fitness exercise apparatus 100, as shown in FIG. 8. To adjust the position of the seat frame 20, the knob 22 is first loosened so that the connector 21 can slide along the slide bar 13 and the seat frame 20 can be positioned at the middle portion 131, the first end 132 or the second end 133 of the slide bar 13, after which the knob 22 is tightened to fix the seat frame 20 at a desired position. Through the roller 261 (see FIG. 3) attached to the bottom end of the foot post 26, the seat frame 20 can be moved smoothly along the ground surface. Before the seat frame 20 is moved to the desired position, the first end of the second cable section 543 of the second cable 54 is first detached from the first end of the first cable section 541 thereof, and is then hooked to the hook 241 of the cable-hooking mechanism 24 and positioned thereat through the magnet 242, so that the second cable section 543 of the second cable 54 is located below the guide rail 23. Hence, when the seat frame 20 is moved, the second cable section 543 of the second cable 54 is moved therewith and will not be exposed during movement of the seat frame 20.

Figure 9:
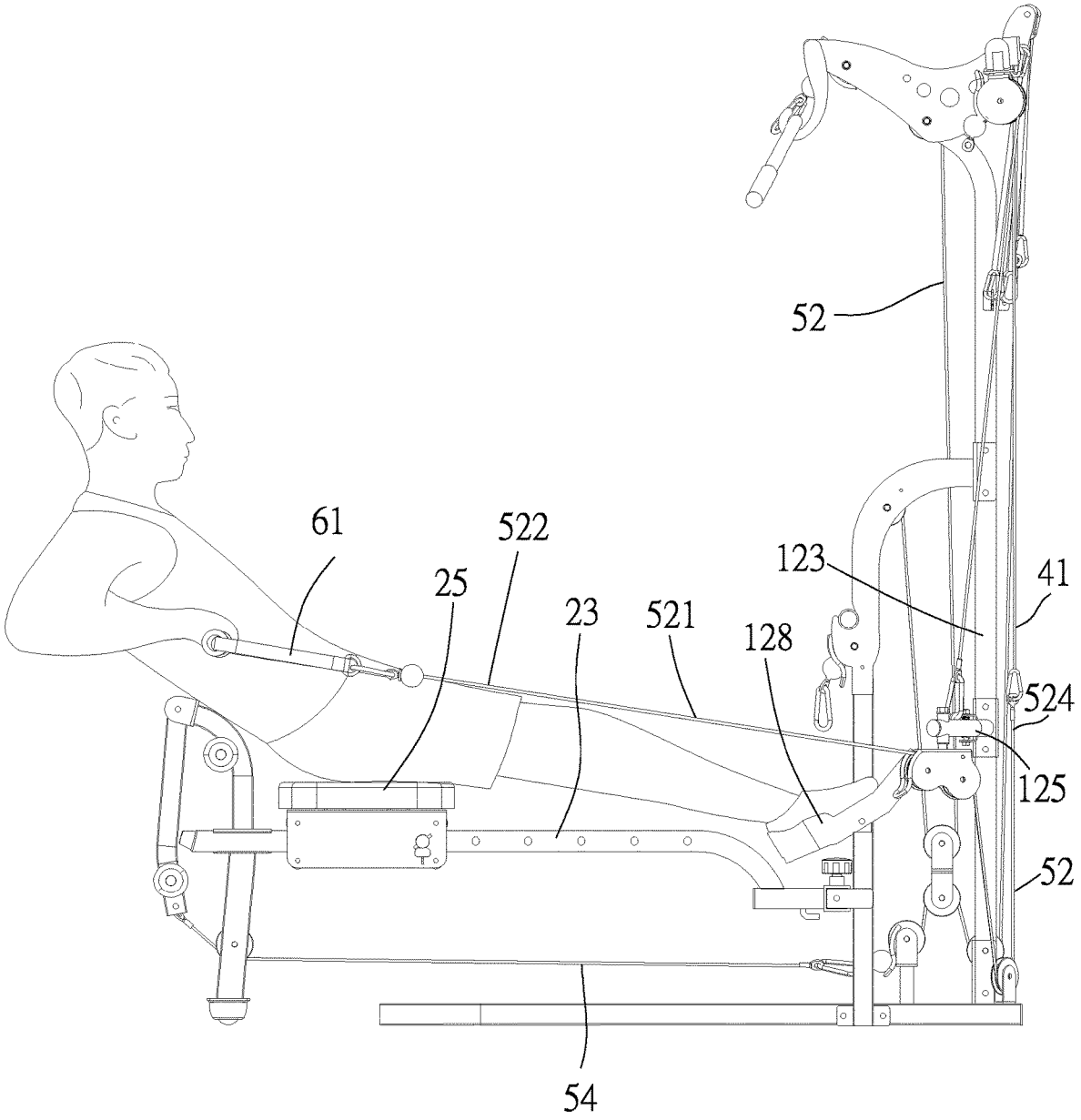
FIG. 9 is a schematic side view of the first embodiment, illustrating how a user can train his back muscle.

Referring to FIG. 9, in combination with FIGS. 1, 2 and 6, the seat frame 20 is positioned at the center of the fitness exercise apparatus 100, the second end 524 of the first cable section 521 of each first cable 52 is connected to the second end of one of the first elastic cords 41, and the handles 61 are respectively connected to the first ends 522 of the first cable sections 521 of the first cables 52. The first cable sections 521 of the first cables 52 are respectively located on the left and right sides of the support post 123 and are substantially parallel to each other. After the user is the seated on the seat assembly 25 with his feet stepping on the pair of foot pedals 128 and with his hands gripping the handles 61, a seated cable row exercise can be performed by the user. In this exercise, the user applies a force to move the seat assembly 25 back and forth along the guide rail 23 toward and away from the support post 123, and must resist the elastic force of the first elastic cords 41 to achieve the purpose of training. Simultaneously, the user's arms can pull the handles 61 so as to use the elastic force of the first elastic cords 41 to generate damping motion, thereby effectively training the latissimus dorsi muscle and the trapezius muscle.

Figure 10:
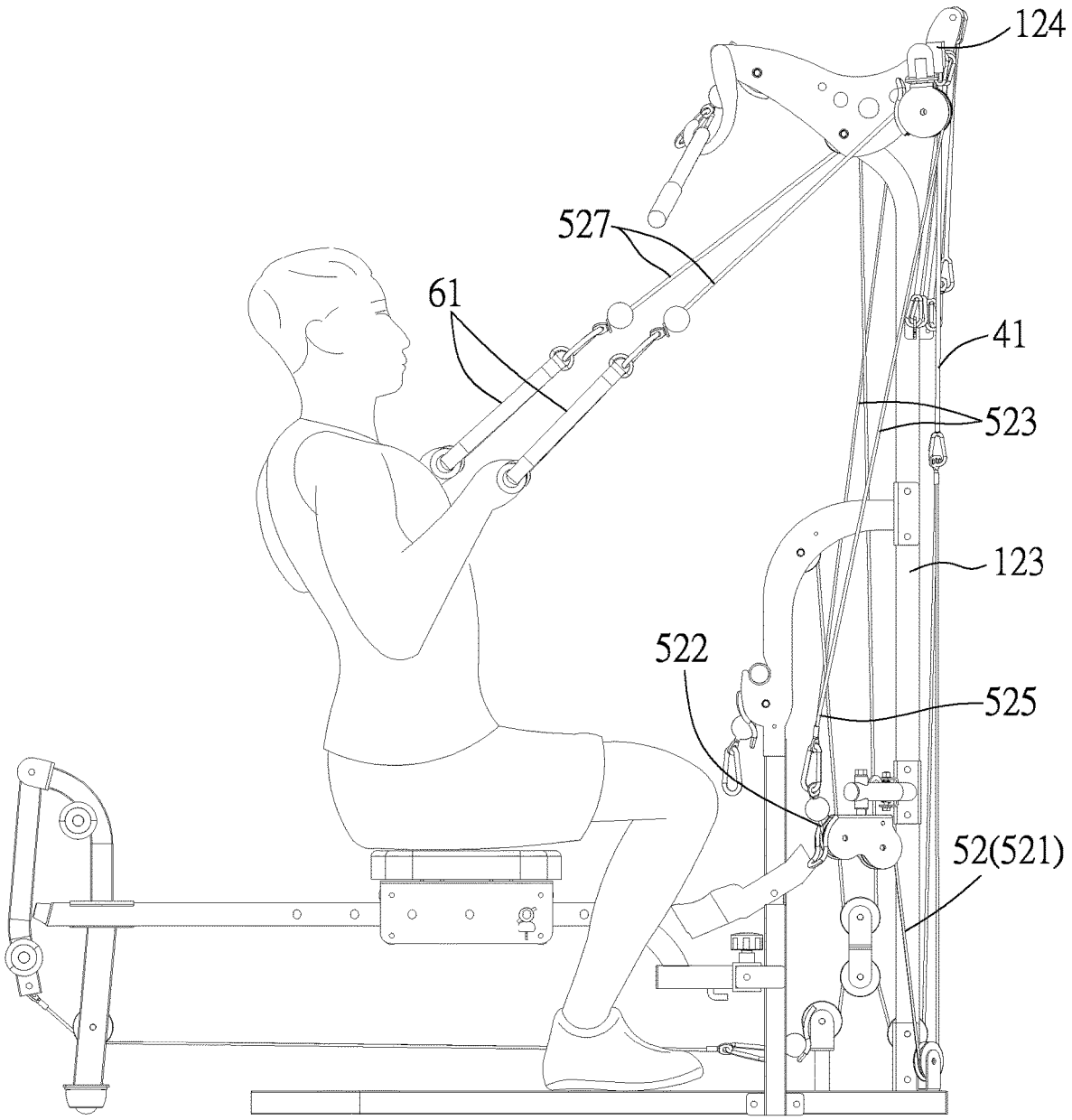
FIG. 10 is a view similar to FIG. 9, but illustrating how the user can perform a chest pull.

Referring to FIG. 10, in combination with FIGS. 1, 2 and 6, the first end 522 of the first cable section 521 and the first end 525 of the second cable section 523 of each first cable 52 are interconnected, and the handles 61 are connected to the second ends 527 of the second cable sections 523 of the first cables 52. After the user is the seated on the seat assembly 25 and faces the support post 123, his two hands grip the handles 61 and then pull the same so as to use the elastic force of the first elastic cords 41 to generate the damping motion and achieve a chest pull exercise or a seated straight arm pulldown exercise.

Figure 11:
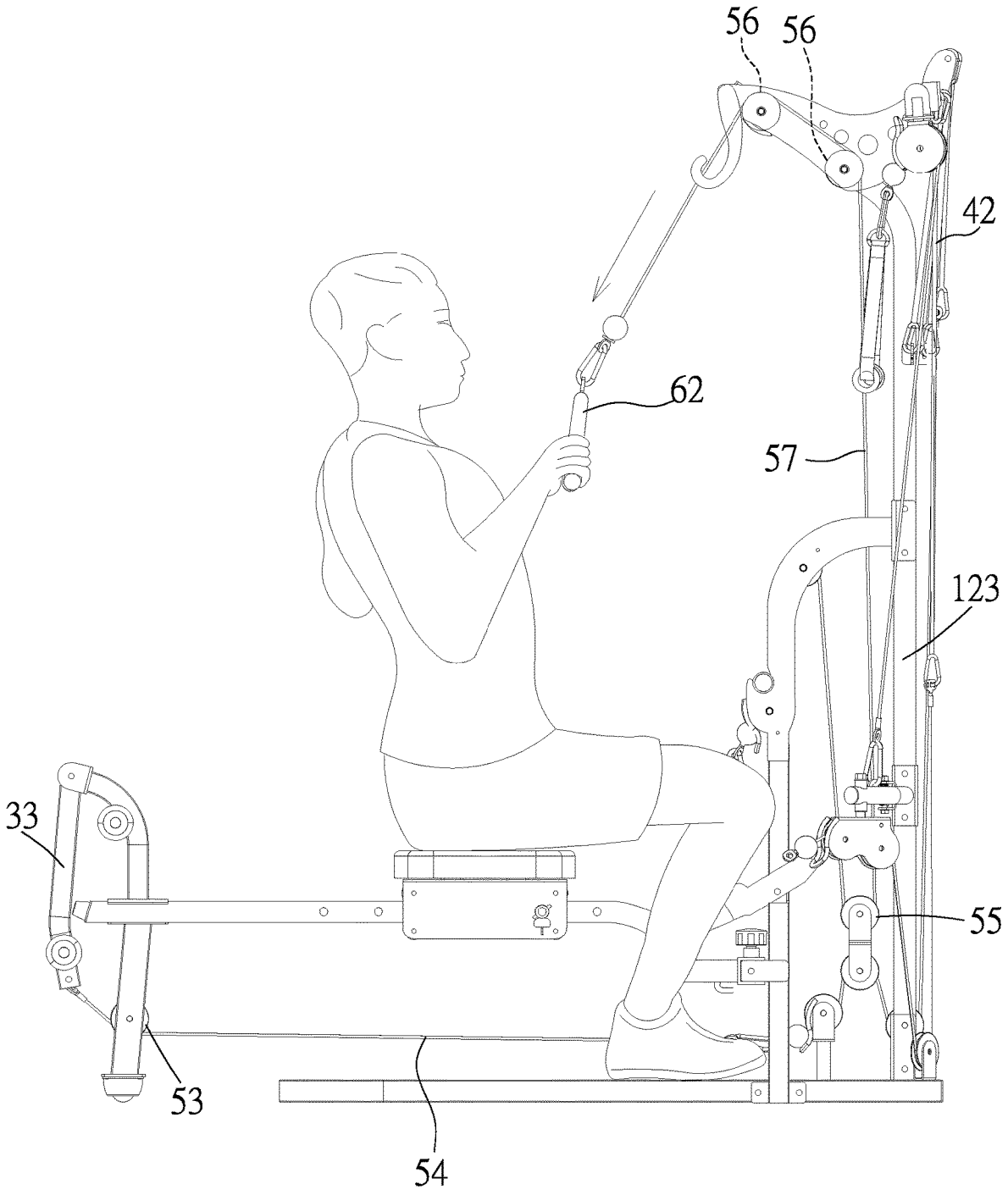
FIG. 11 is a view similar to FIG. 9, but illustrating how the user can perform a wide-grip lat pulldown exercise.

Referring to FIG. 11, in combination with FIGS. 1 and 6, the upper pull rod 62 is connected to the second end of the auxiliary cable 57. After the user is seated on the seat assembly 25 and faces the support post 123, through the movable pulley set 55 pulling the second cable 54 and through the connection of the second cable 54 with at least one of the second elastic cords 42, the hands of the user can pull down the upper pull rod 62 to perform a wide grip lat pulldown exercise. If the user sits facing away from the support post 123, a wide grip rear pulldown exercise can be performed (not shown).

Figure 12:
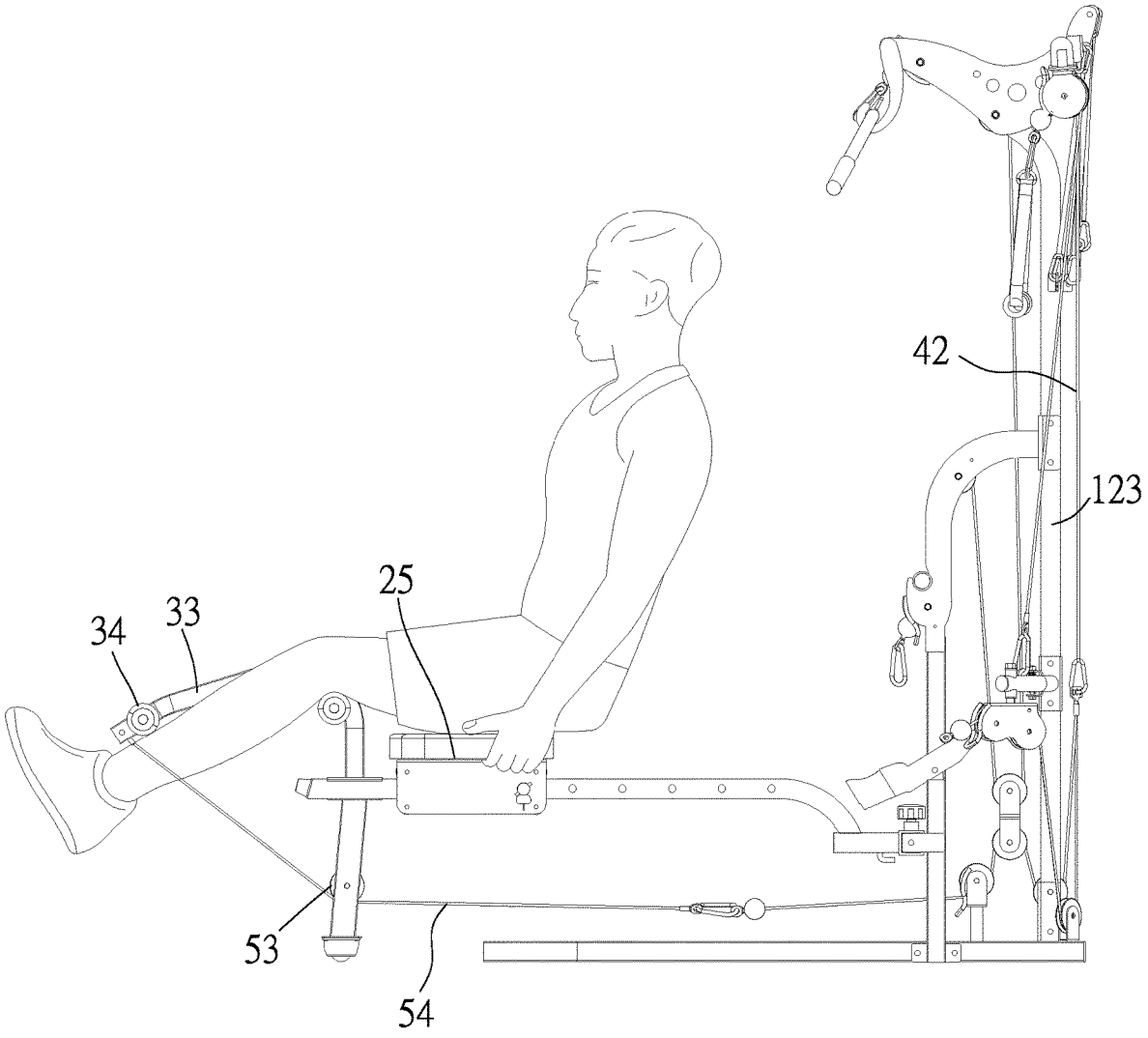
FIG. 12 is a view similar to FIG. 9, but illustrating how the user can perform a leg extension exercise.

Referring to FIG. 12, the user sits on the seat assembly 25 facing away from the support post 123 with his hands gripping two sides of the seat assembly 25 and with his feet hooked onto the positioning rods 34. When the user uses his feet to apply a force to move the swing rod 33 upwardly, the second cable 54 can be moved to pull the at least one of the second elastic cords 42, so that a leg extension exercise can be performed.

Figure 13:
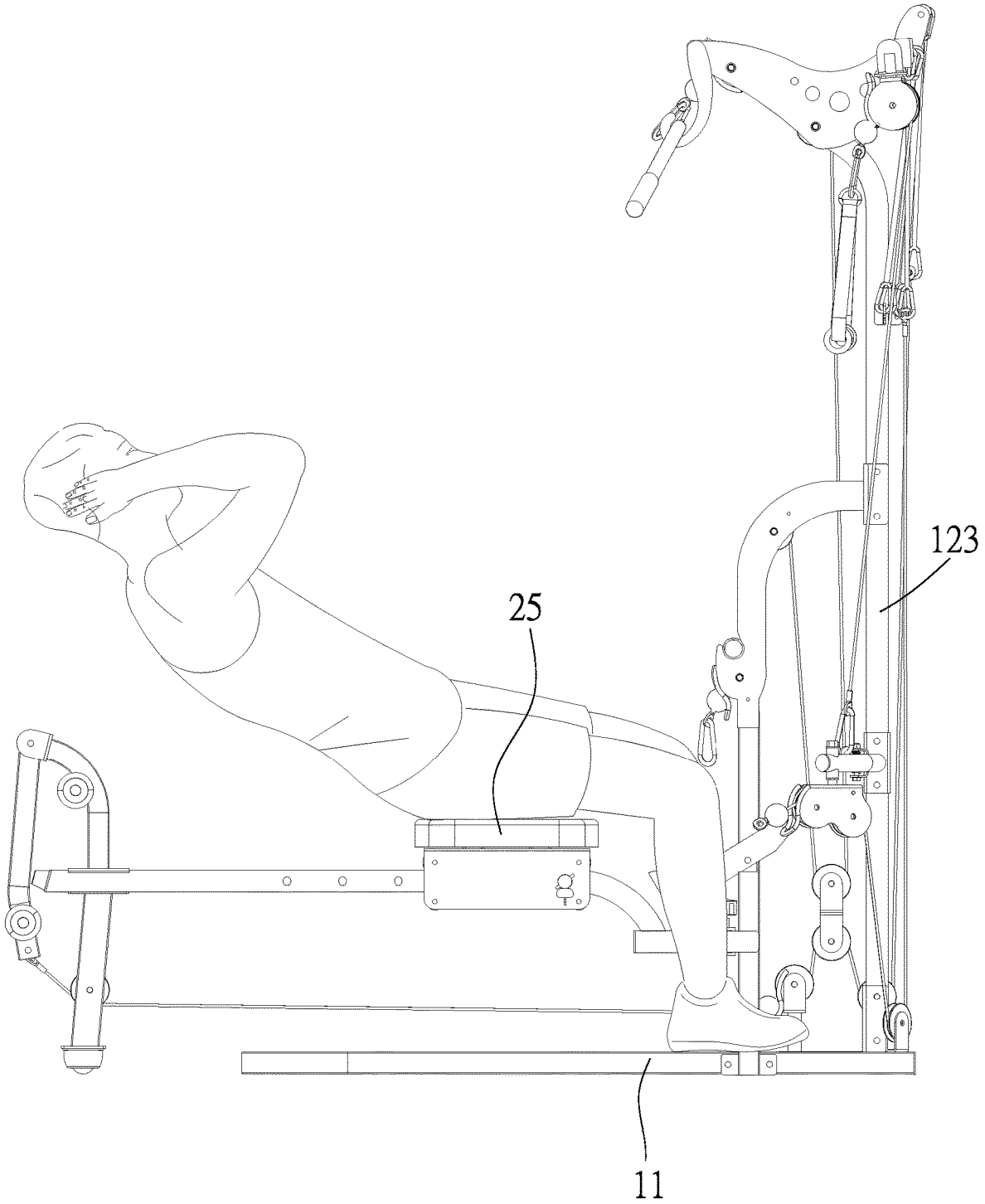
FIG. 13 is a view similar to FIG. 9, but illustrating how the user can perform an abdominal crunch exercise.

Referring to FIG. 13, an abdominal crunch exercise can be performed by the user after being seated on the seat assembly 25 facing the support post 123 with his feet stepping on the base member 11.

Referring to FIG. 14, the seat frame 20 is first positioned either on the left or right side of the fitness exercise apparatus 100 (see FIGS. 7 and 8), after which the upper pull rod 62 is connected to the second end of the auxiliary cable 57. The user then stands on the base member 11, and with his hands pulling down the upper pull rod 62, a triceps push down exercise can be performed.

Figure 15:
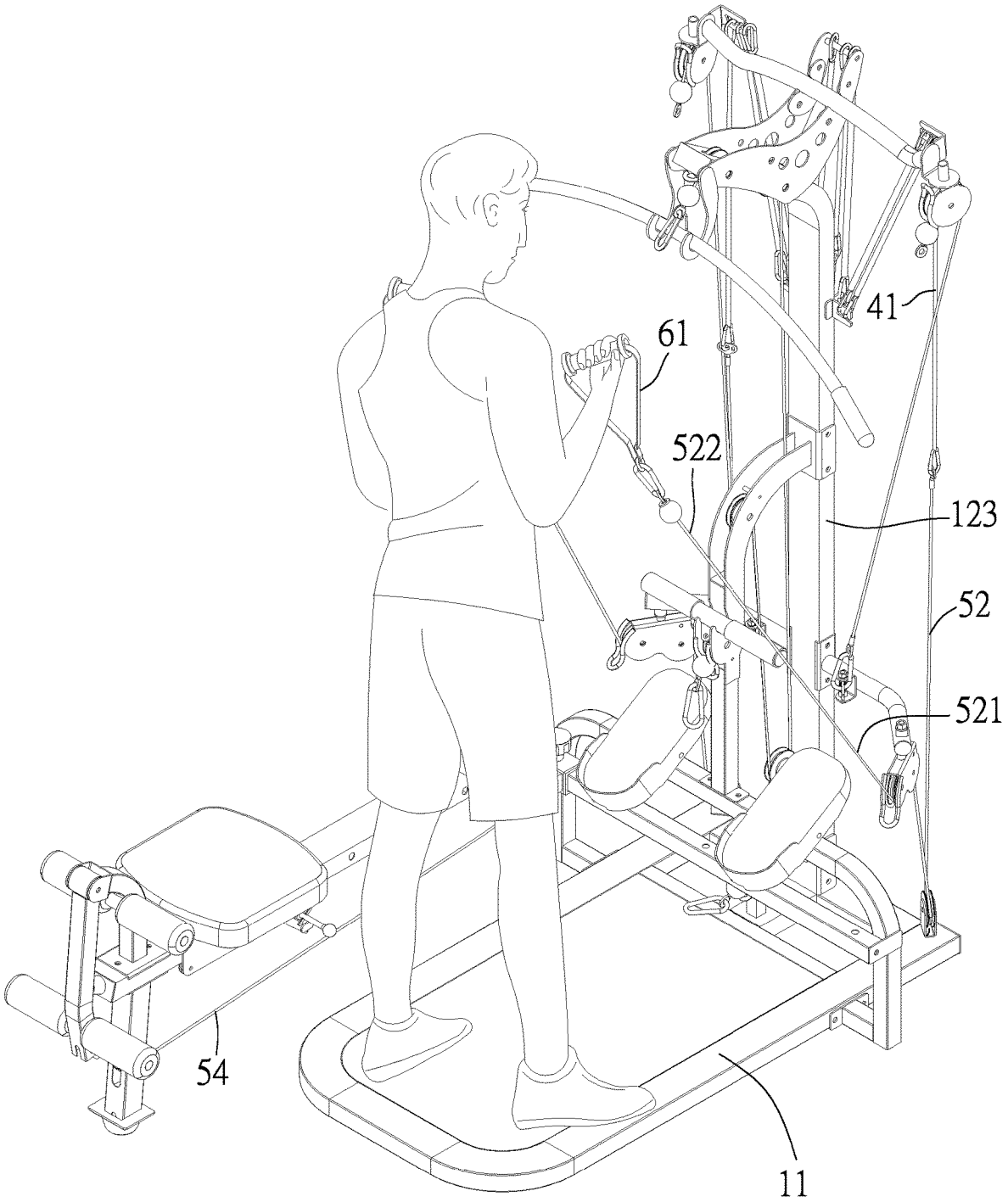
FIG. 15 is a view similar to FIG. 14, but illustrating how the user can perform a standing bicep curl low pulley exercise.

Referring to FIG. 15, the seat frame 20 is first positioned on the left (or right) side of the fitness exercise apparatus 100, and the handles 61 are connected to the first ends 522 of the first cable sections 521 of the first cables 52. Afterwards, the user stands on the base member 11, and with his hands gripping the handles 61, the user's arms can then pull the handles 61 to perform a standing bicep curl low pulley exercise. The user may also use one hand to grip one handle 61 so as to perform a one arm bicep curl low pulley exercise; may use two hands to grip one handle 61 to perform a standing close grip bicep curl exercise; or, may use one hand to grip one handle 61 and with his body slanting relative to the fitness exercise apparatus 100 to perform a cross body bicep curl exercise. Further, the user may stand facing away from the support post 123 to perform a reverse standing bicep curl exercise, or may stand facing the support post 123 to perform a standing low pulley cable fly exercise. The above exercises differ only in training the different parts of the user's body, so they are not shown here.

Figure 16:
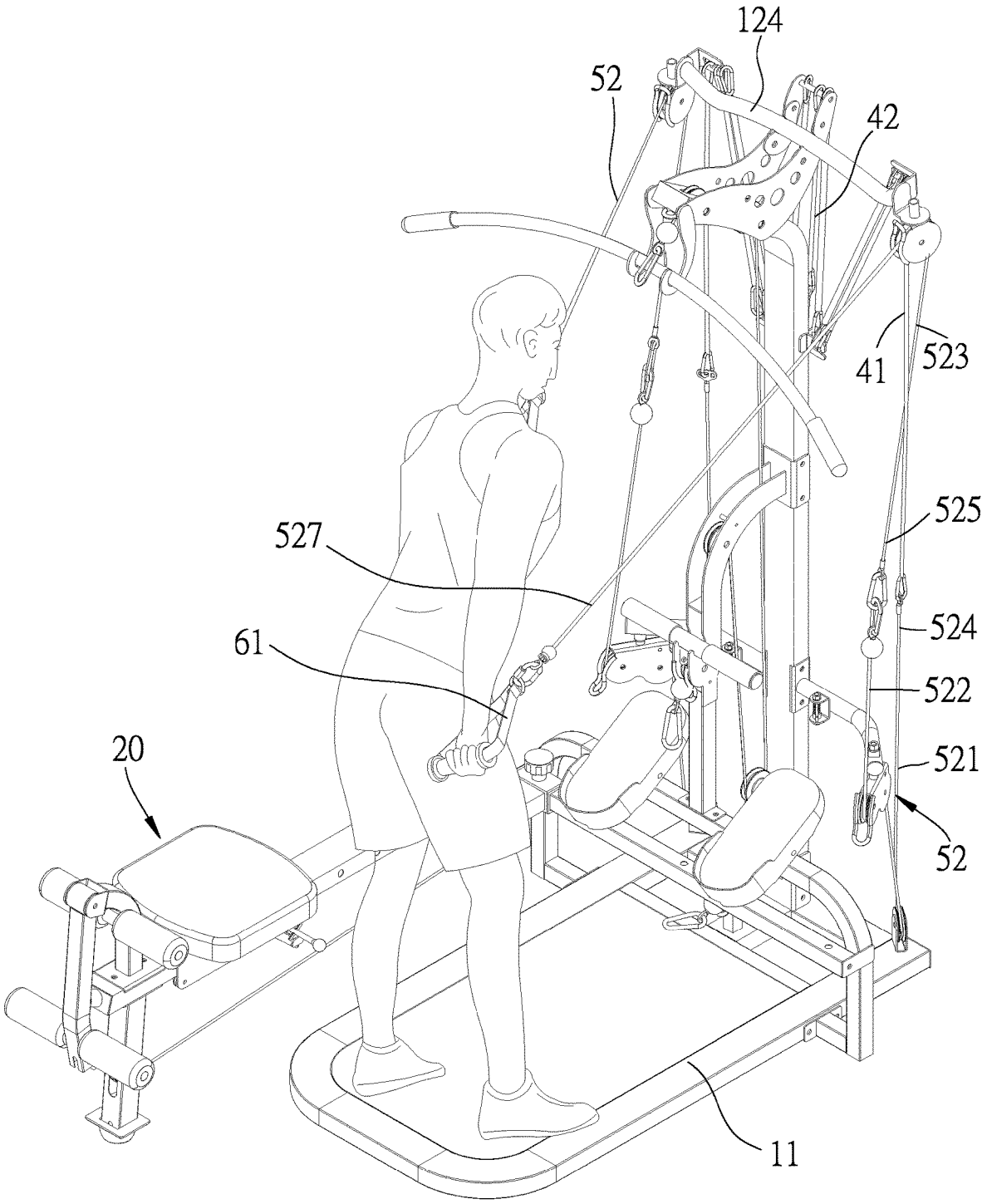
FIG. 16 is a view similar to FIG. 14, but illustrating how the user can perform a straight arm pulldown exercise.

FIG. 16 illustrates an assembly similar to that of FIG. 15, but with the first end 522 of the first cable section 521 and the first end 525 of the second cable section 523 of each first cable 52 being interconnected, and with the handles 61 being connected to the second ends 527 of the second cable sections 523 of the first cables 52. As shown, with the user standing on the base member 11 and with his hands gripping the handles 61, the user's arms can then pull the handles 61 downward to perform an alternating straight arm pulldown exercise, or a standing straight arm pulldown exercise (not shown).

Figure 17:
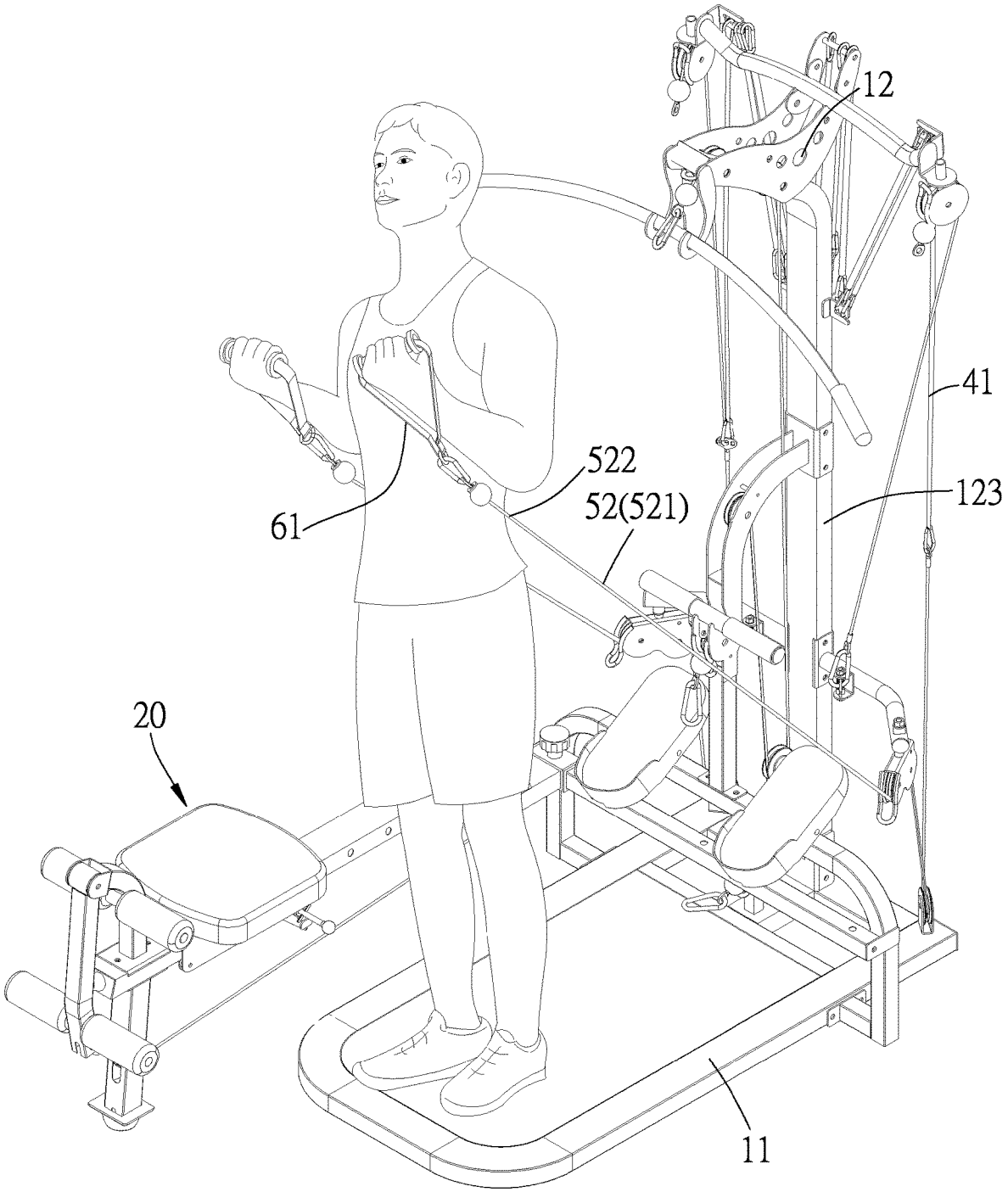
FIG. 17 is a view similar to FIG. 14, but illustrating how the user can perform a reverse standing bicep curl low pulley exercise.

FIG. 17 illustrates an assembly similar to that of FIG. 15, and as shown, the user stands on the base member 11 facing away from the support post 123, and with his hands gripping the handles 61, the user's arms can then pull the handles 61 to perform a reverse standing bicep curl low pulley exercise.

Figure 18:
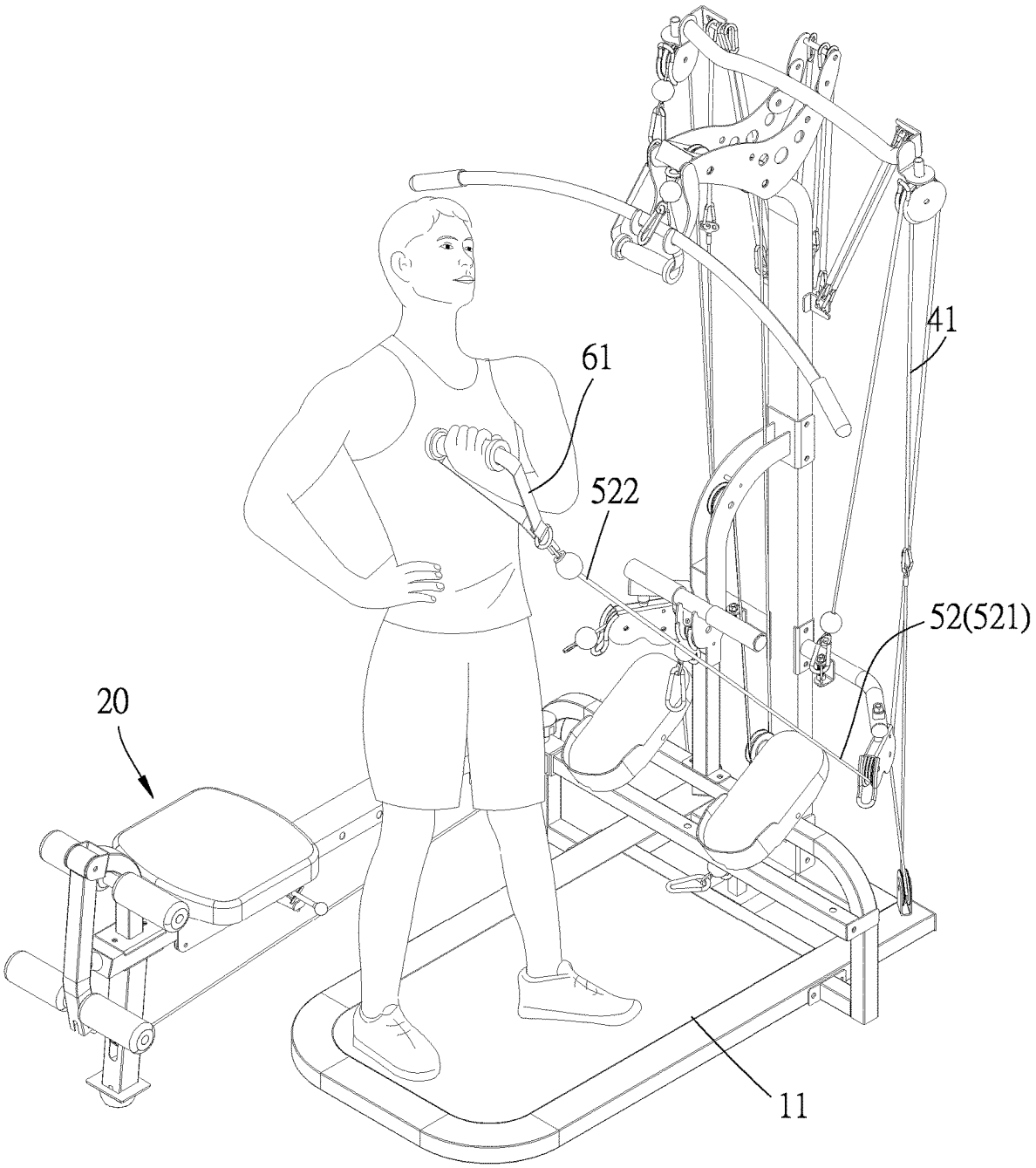
FIG. 18 is a view similar to FIG. 14, but illustrating how the user can perform a cross body bicep curl exercise.

FIG. 18 illustrates an assembly similar to that of FIG. 15, but with the user standing on the base member 11 in a slant manner and with his one hand gripping one handle 61, the user's arm can then pull the handle 61 upward to perform a cross body bicep curl exercise.

Figure 19:
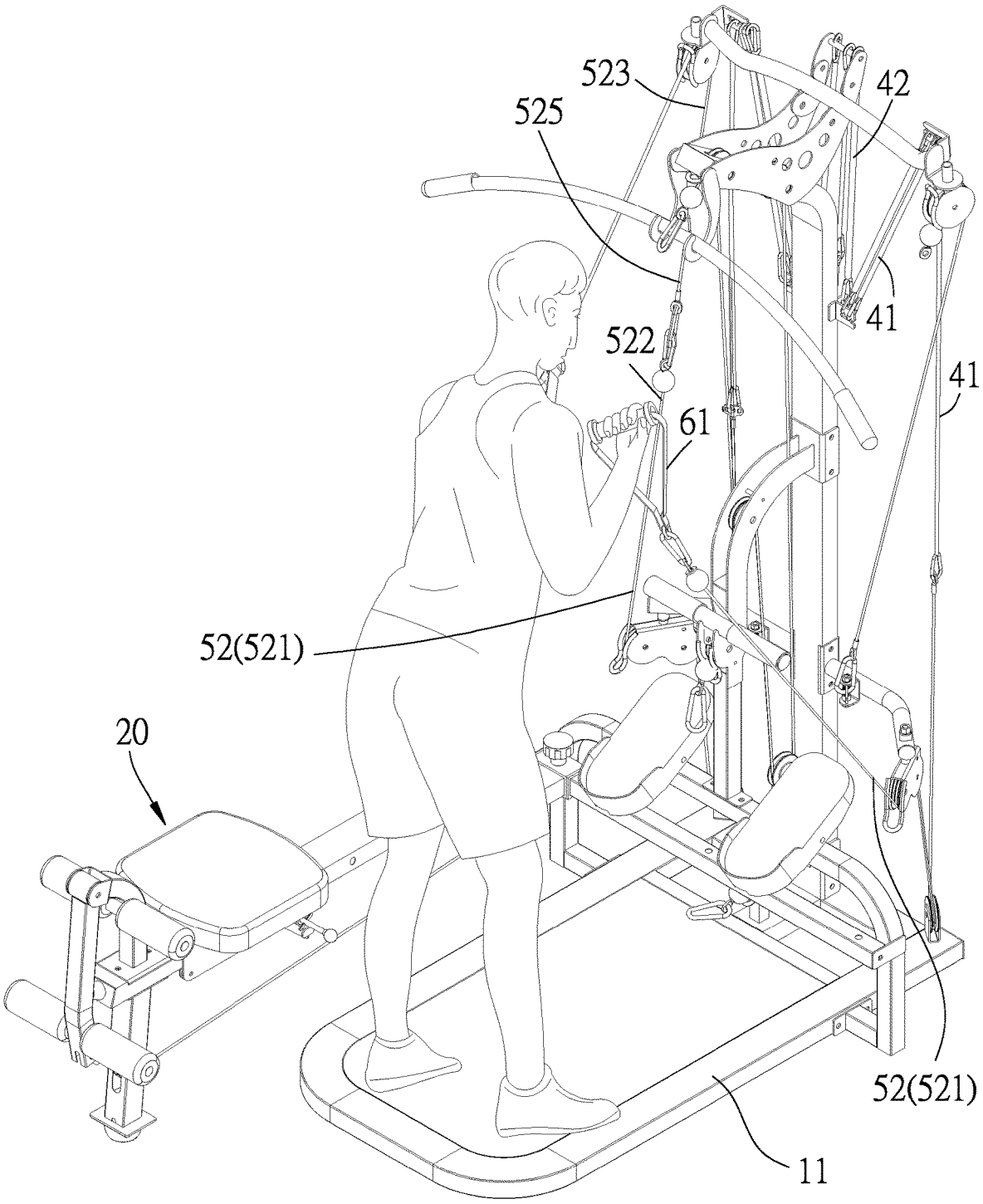
FIG. 19 is a view similar to FIG. 14, but illustrating how the hands of the user can be exercised by moving them toward and away from each other in an up-down direction.

FIG. 19 illustrates an assembly similar to that of FIG. 15, but with a left one of the handles 61 connected to the second end 527 of the second cable section 523 of the first cable 52, and with the first end 522 of the first cable section 521 and the first end 525 of the second cable section 523 of the first cable 52 being interconnected. In this way, with the user standing on the base member 11 and with his hands gripping the handles 61, the user's arms can then pull the handles 61 to move toward and away from each other in an up-down direction to exercise both hands of the user.

Figure 20:
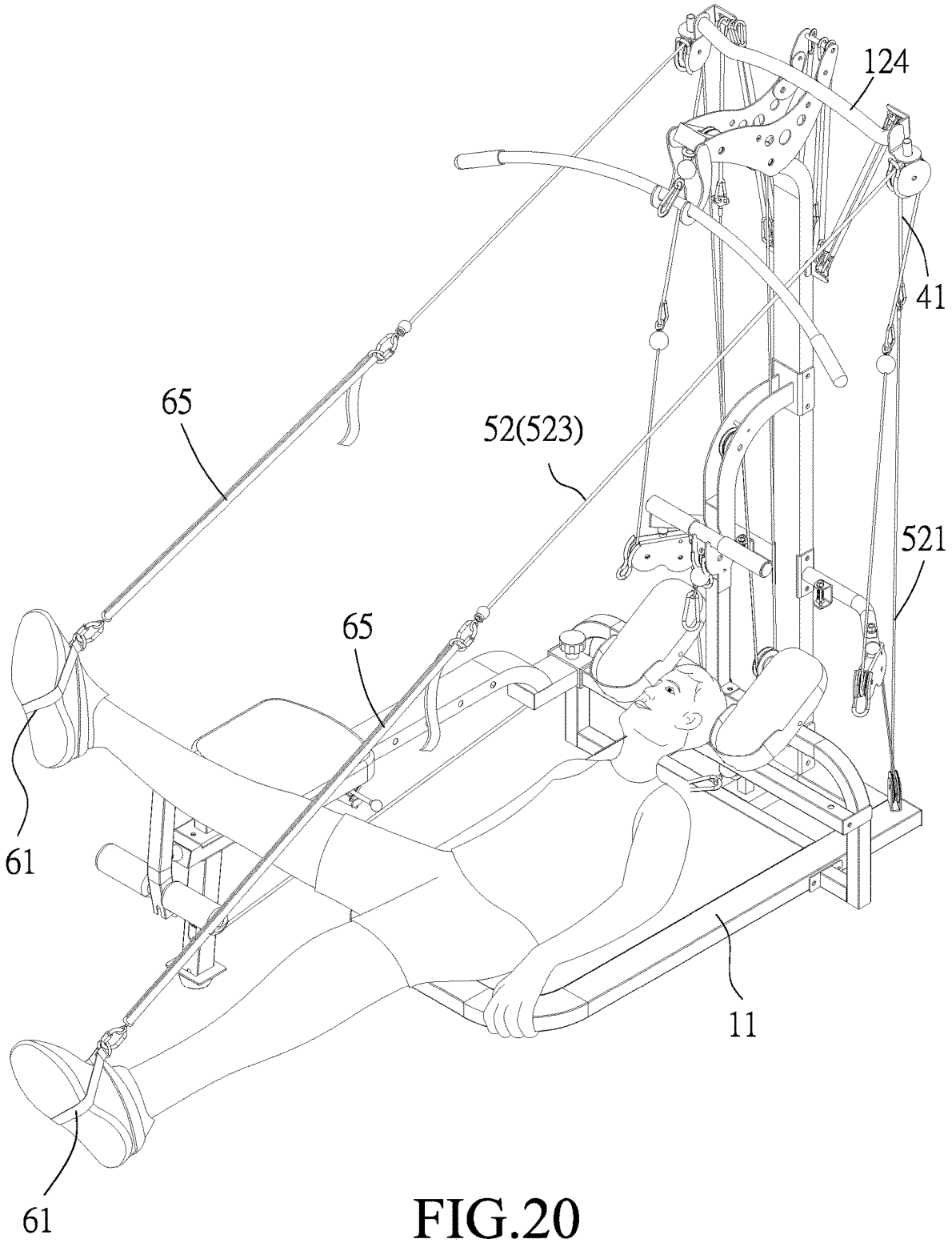
FIG. 20 is a view similar to FIG. 14, but illustrating how the feet of the user can be exercised while lying down on a base member of the first embodiment.

FIG. 20 illustrates an assembly similar to that of FIG. 16, but with the handles 61 respectively provided with an extension strap 65. As shown, with the user lying down on the base member 11 and with his feet hooking onto the handles 61, an alternate leg pulldown exercise can be performed.

It should be noted herein that, when the lower pull rod 63 is connected to the first end of the auxiliary cable 57 and the user is seated on the seat assembly 25, a rowing exercise can be performed by the user (not shown).

Figure 21:
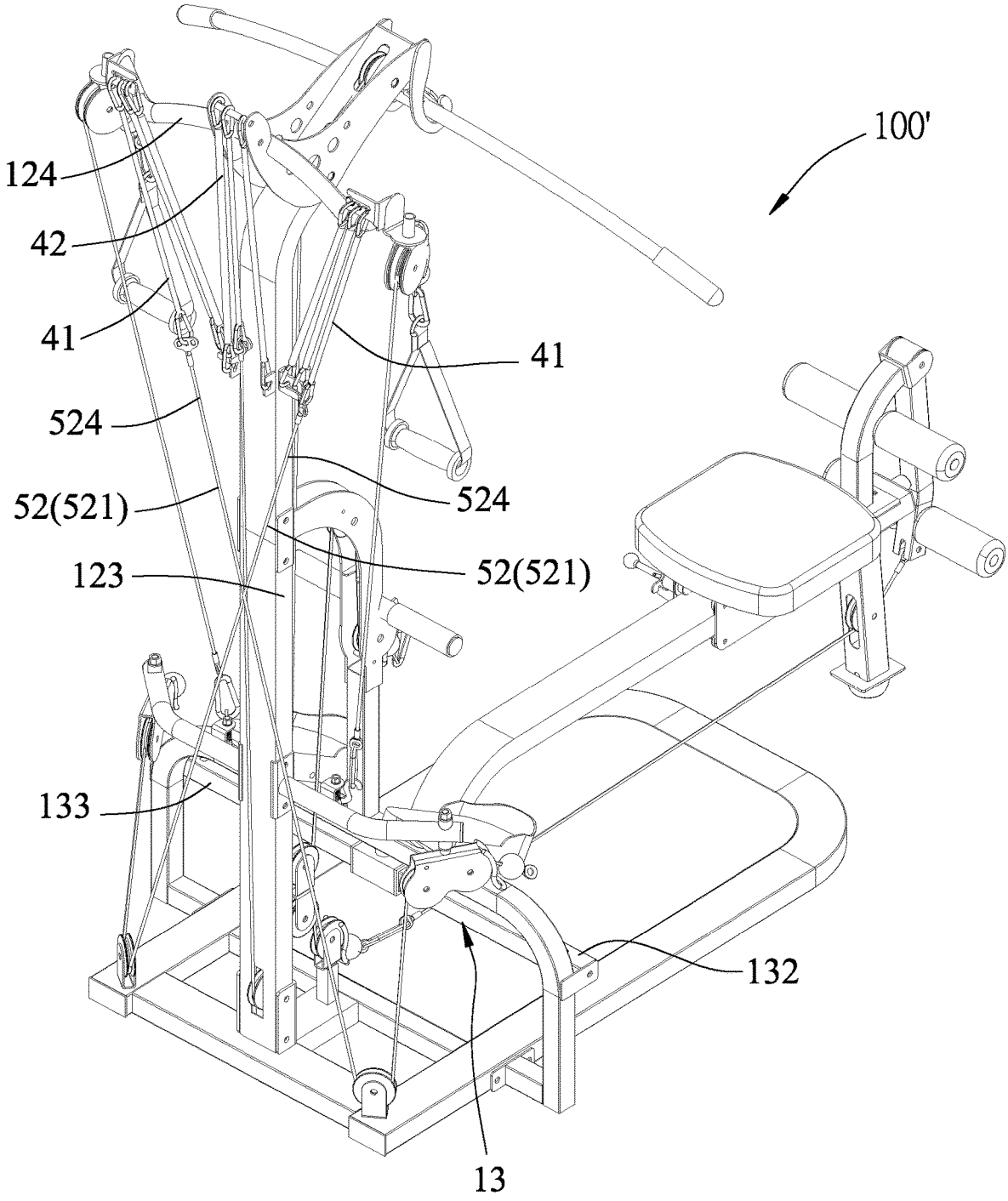
FIG. 21 is a perspective view of a fitness exercise apparatus according to the second embodiment of the present disclosure.

Referring to FIG. 21, the second embodiment of the fitness exercise apparatus 100' of this disclosure is shown to be identical to the first embodiment, and differs in that the second ends 524 of the first cable sections 521 of the first cables 52 are respectively connected to at least one of the first elastic cords 41 that are disposed on the two opposite ends of the cross bar 124 such that the first cable sections 521 of the first cables 52 cross each other at a front side of the support post 123. That is, the second end 524 of the first cable section 521 of the first cable 52 located on the right side of the support post 123 is connected to the second end of the at least one of the first elastic cords 41 located on the left side of the support post 123, while the second end 524 of the first cable section 521 of the first cable 52 located on the left side of the support post 123 is connected to the second end of the at least one of the first elastic cords 41 located on the right side of the support post 123, so that the first cable sections 521 of the first cables 52 form a cross shape at the front side of the support post 123.

It is worth to mention herein that, in actual practice, different thicknesses and different numbers of the first and second elastic cords 41, 42 may be used to obtain different damping effects and to meet the different demands of training, and the damping curve of each of the first and second elastic cords 41, 42 (F=KX, external force is proportional to elongation) is similar to the human muscle strength. The damping can be changed from 10 to 100 kgs. regardless of the user's sex and age. Further, by using the combination of the first cables 52 and the first elastic cords 41 and the combination of the second cable 54 and the second elastic cords 42, the range of different kinds of users is wide.

The efficiency of this disclosure can be summarized as follows:

1. When performing standing stretching exercises, the first elastic cords 41 and the second elastic cords 42 can be directly stretched without the need to pass through a slide shaft, so that the service life thereof can be effectively prolonged.

2. Through the provision of the cross bar 124 and the pair of support plates 129 on the top portion 122 of the support post 123, the appearance of this disclosure can be enhanced.

3. Depending on the training requirements, the first end 522 of the first cable section 521 of each first cable 52 can be connected to the first end 525 of the second cable section 523 thereof to perform standing stretching exercises. When the first end 525 of the second cable section 523 of each first cable 52 is not in use, the first end 525 thereof can be hooked to the retainer provided on the corresponding left or right side of the hanging rod 125.

4. Because the seat frame 20 is movable along the horizontal direction (X), the fitness exercise apparatus 100, 100' can further provide standing and lying exercises for the user, and has enough space, so that it is convenient for the user to perform different exercise modes.

In summary, the fitness exercise apparatus 100, 100' of this disclosure has a simple overall structure, and the seat frame 20 can be moved along the horizontal direction (X) through the connector 21 that is slidable along the slide bar 13 and through the roller 261 attached to the bottom portion of the foot post 26 so as to meet the needs of the user for performing different exercise modes. Therefore, the object of this disclosure can indeed be achieved.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A fitness exercise apparatus comprising:

a main frame including a base member configured to be disposed on a support surface, a support unit disposed on said base member, and a slide bar that is disposed on said support unit and extends along a horizontal direction, and that has a first end and a second end opposite to each other along the horizontal direction, and a middle portion between said first end and said second end;

said support unit including a support post that has a bottom portion connected to said base member and a top portion opposite to said bottom portion, a cross bar disposed on said top portion of said support post and having two opposite ends respectively located on two opposite sides of said support post along the horizontal direction, a hanging rod connected to said support post between said top and bottom portions thereof and having two opposite ends respectively located on said two opposite sides of said support post, and two wheel frames respectively disposed on said two opposite ends of said hanging rod;

a seat frame slidably mounted on said slide bar and including a connector connected to said slide bar and slidable between said first end and said second end thereof, a guide rail connected to said connector and transverse to said slide bar, a seat assembly slidably disposed on said guide rail, and a foot post connected to said guide rail opposite to said connector and disposed rearwardly of said base member;

a swing frame connected to said guide rail at a position corresponding to said foot post;

an elastic cord unit including a plurality of first elastic cords and a plurality of second elastic cords connected to said support unit;

a pulling unit including three first pulley sets disposed on said base member and said support unit, two first cables, a second pulley set including three pulleys respectively disposed on said bottom portion of said support post, said base member and said foot post, and a second cable looped around said three pulleys of said second pulley set and connectable with at least one of said plurality of second elastic cords; and an operating unit connectable with said two first cables;

wherein a first one of said three first pulley sets is disposed on said base member, a second one of said three first pulley sets is disposed on said two wheel frames, and a third one of said three first pulley sets is disposed on said cross bar;

wherein said first one of said three first pulley sets includes two pulleys respectively disposed on two opposite sides of said base member that correspond to said two opposite sides of said support post, said second one of said three first pulley sets including two pairs of pulleys respectively disposed on said two wheel frames, said third one of said three first pulley sets including two pulleys respectively disposed on said two opposite ends of said cross bar; and wherein said two first cables are respectively located on said two opposite sides of said support post, and each of said two first cables is looped around one of said two pulleys of said first one of said three pulley sets, one of said two pairs of pulleys of said second one of said three pulley sets, and one of said two pulleys of said third one of said three pulley sets, each of said two first cables being connectable with at least one of said plurality of first elastic cords.

2. The fitness exercise apparatus as claimed in claim 1, wherein said foot post has a bottom portion attached with a roller for rolling contact with the support surface.

3. The fitness exercise apparatus as claimed in claim 2, wherein:

said top portion of said support post is provided with a pair of support plates at a top end thereof, said cross bar being disposed on said pair of support plates, said support unit further including a fixing frame connected between said base member and said support post;

said slide bar is connected to said fixing frame;

said plurality of first elastic cords are disposed on said two opposite ends of said cross bar; and said plurality of second elastic cords are disposed on said pair of support plates.

4. The fitness exercise apparatus as claimed in claim 3, wherein said pulling unit further includes a movable pulley set disposed in proximity to said bottom portion of said support post, two auxiliary pulley sets respectively disposed on said top portion of said support post and said fixing frame, and an auxiliary cable that is looped around one of said two auxiliary pulley sets, said movable pulley set and the other one of said two auxiliary pulley sets and that has two opposite ends respectively extending out of said two auxiliary pulley sets, said operating unit being further connectable with one of said two opposite ends of said auxiliary cable.

5. The fitness exercise apparatus as claimed in claim 4, wherein said swing frame includes a connecting rod connected to said guide rail at a position corresponding to said foot post, two knee support rods connected to two opposite sides of said connecting rod, a swing rod pivoted to a top end of said connecting rod and swingable toward and away from said foot post, and two positioning rods connected to two opposite sides of said swing rod and distal to said two knee support rods.

6. The fitness exercise apparatus as claimed in claim 1, wherein each of said two first cables includes:

a first cable section having a first end extending out of one of said pairs of pulleys of said second one of said three first pulley sets and connectable with said operating unit, and a second end looped around one of said pulleys of said first one of said three first pulley sets and then extending out of the same for connection with said at least one of said plurality of first elastic cords; and a second cable section having a first end selectively connected to one of said hanging rod and said first end of said first cable section, and a second end looped around one of said pulleys of said third one of said three first pulley sets and then extending out of the same for connection with said operating unit.

7. The fitness exercise apparatus as claimed in claim 6, wherein said second ends of said first cable sections of said two first cables are respectively connected to said at least one of said plurality of first elastic cords that are disposed on said two opposite ends of said cross bar such that said first cable sections of said two first cables are respectively located on said two opposite sides of said support post and are substantially parallel to each other.

8. The fitness exercise apparatus as claimed in claim 6, wherein said second ends of said first cable sections of said two first cables are respectively connected to said at least one of said plurality of first elastic cords that are disposed on said two opposite ends of said cross bar such that said first cable sections of said two first cables cross each other at a front side of said support post.

* * * * *